US009802632B2

(12) United States Patent
Voyer

(10) Patent No.: US 9,802,632 B2
(45) Date of Patent: Oct. 31, 2017

(54) METHOD AND DEVICE FOR REDUCING DRIVE DELAY OF ROLLING STOCK TO REACH DESTINATION

(71) Applicant: MITSUBISHI ELECTRIC CORPORATION, Tokyo (JP)

(72) Inventor: Nicolas Voyer, Rennes (FR)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/315,692

(22) PCT Filed: Jul. 23, 2015

(86) PCT No.: PCT/JP2015/003686
§ 371 (c)(1),
(2) Date: Dec. 1, 2016

(87) PCT Pub. No.: WO2016/017120
PCT Pub. Date: Feb. 4, 2016

(65) Prior Publication Data

US 2017/0197645 A1 Jul. 13, 2017

(30) Foreign Application Priority Data

Jul. 29, 2014 (EP) ..... 14178976

(51) Int. Cl.
*B61L 27/00* (2006.01)
*B61L 25/02* (2006.01)
*B61L 27/04* (2006.01)

(52) U.S. Cl.
CPC ..... *B61L 27/0022* (2013.01); *B61L 25/021* (2013.01); *B61L 25/025* (2013.01); *B61L 27/04* (2013.01); *B61L 2201/00* (2013.01)

(58) Field of Classification Search
CPC .. B61L 27/0022; B61L 25/021; B61L 25/025; B61L 27/04; B61L 2201/00
See application file for complete search history.

(56) References Cited

U.S. PATENT DOCUMENTS 4,700,302 A * 10/1987 Arakawa ..... G05D 1/0265 180/168
5,563,608 A * 10/1996 Tachita ..... G01C 21/30 342/357.28

(Continued)

FOREIGN PATENT DOCUMENTS

| | | |
|---|---|---|
| EP | 1 466 803 A1 | 10/2004 |
| GB | 923915 | 4/1963 |
| JP | 7-245813 A | 9/1995 |

OTHER PUBLICATIONS

Priebe et al., "Automatic Train Operation LZB 700-Eine leistungsfähige Steuerung für den Nahverkehr mit Fuzzy Control", ETR, vol. 43, No. 1-2, Jan. 1, 1994, pp. 63-70.

*Primary Examiner* — Richard M Camby
(74) *Attorney, Agent, or Firm* — Birch, Stewart, Kolasch & Birch, LLP

(57) ABSTRACT

The present invention concerns a method for reducing the drive delay of a rolling stock to reach a destination, the rolling stock being driven by a driver to follow a running profile that defines the speeds and positions of the rolling stock at different timings. The method comprises the steps of: —determining a current timing, —getting a nominal acceleration of the rolling stock, the nominal acceleration being determined by the driver of the rolling stock to follow the running profile at the current timing, —determining the speed error of the rolling stock with the rolling profile, —determining the position error of the rolling stock with the rolling profile, —determining an estimate of the time to reach the destination, —determining a marginal acceleration (Continued)

from the speed error, the position error and the estimated time to reach the destination, —accelerating the rolling stock with the sum of nominal and determined marginal accelerations.

10 Claims, 3 Drawing Sheets

(56) References Cited

U.S. PATENT DOCUMENTS

| | | | | |
|---|---|---|---|---|
| 2011/0313662 | A1* | 12/2011 | Huang ..... | G01C 21/30<br>701/418 |
| 2013/0325224 | A1 | 12/2013 | Yamamoto et al. | |

* cited by examiner

[Fig. 1]
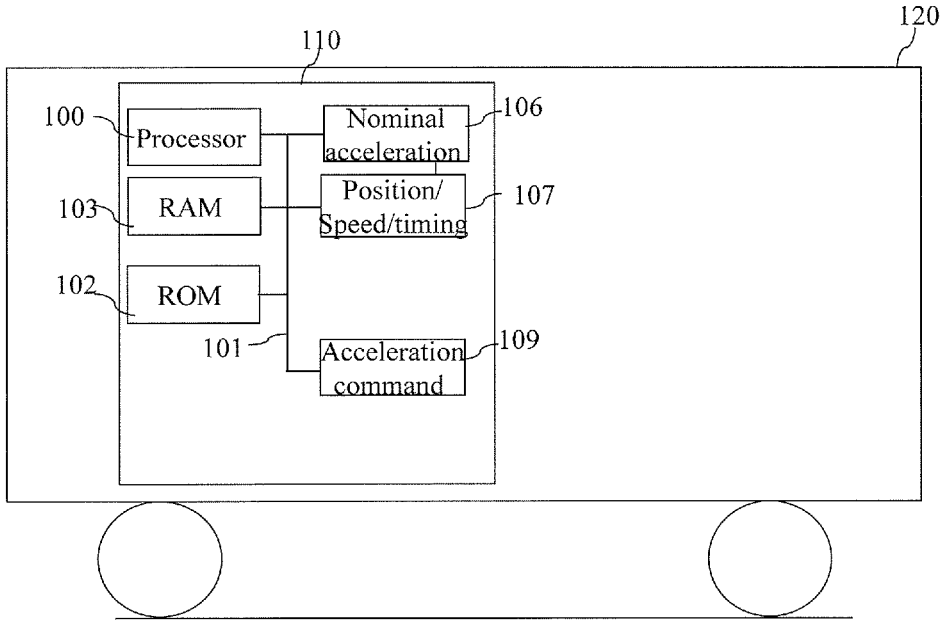

[Fig. 2]
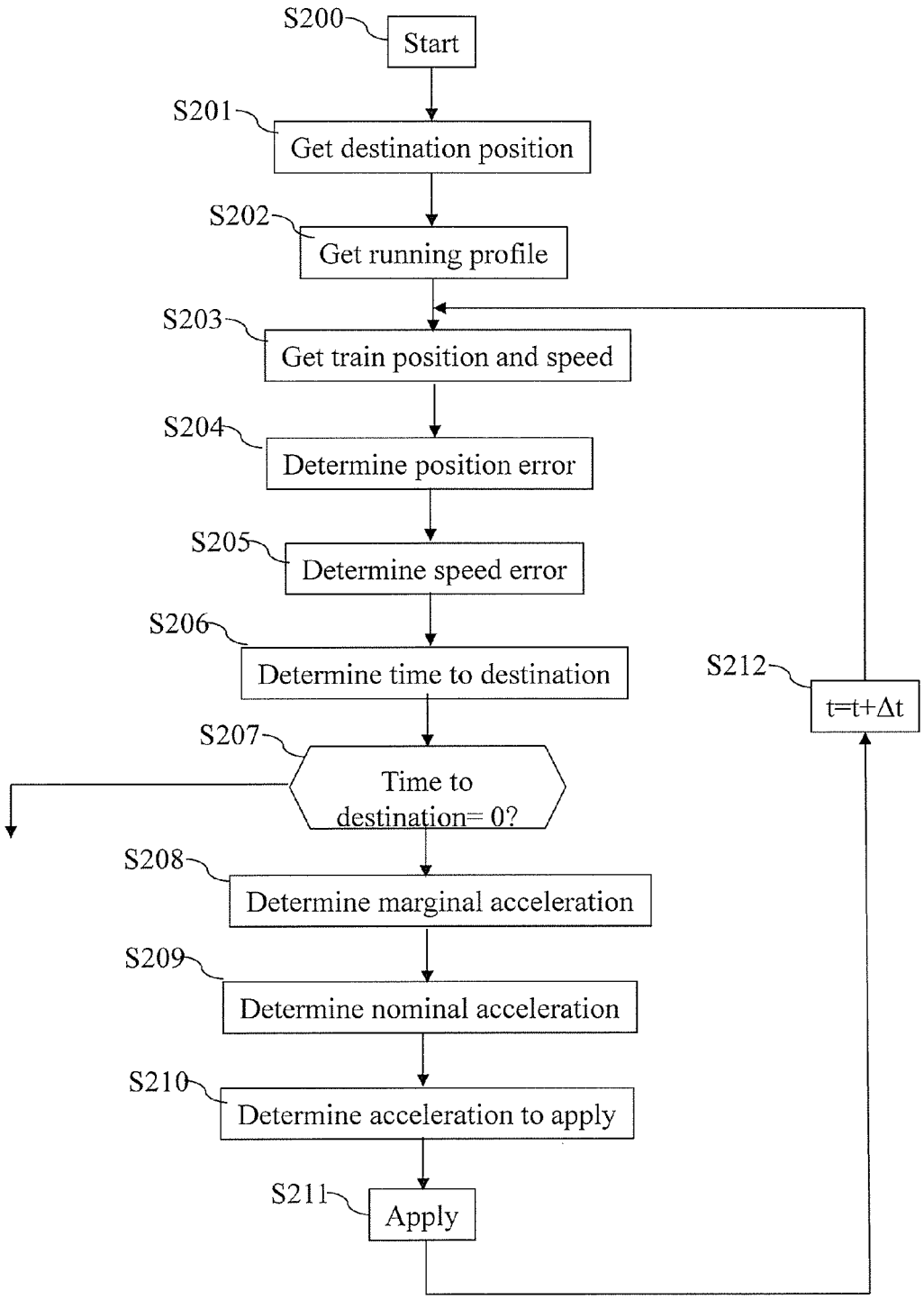

[Fig. 3]
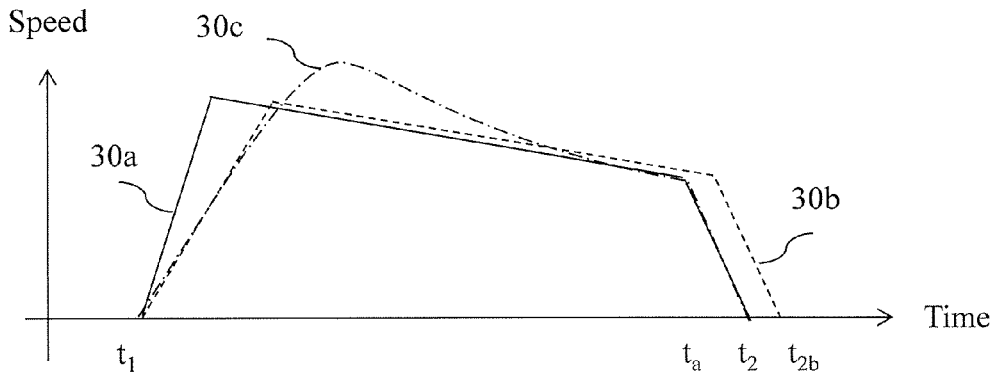
[Fig. 4]
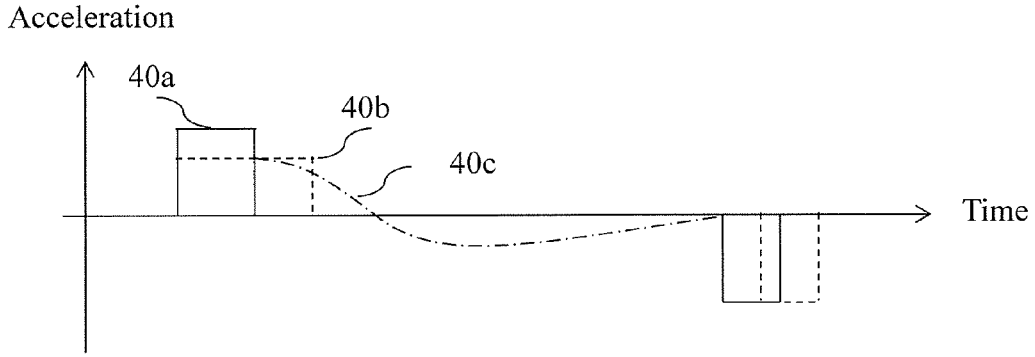

METHOD AND DEVICE FOR REDUCING DRIVE DELAY OF ROLLING STOCK TO REACH DESTINATION

TECHNICAL FIELD

The present invention relates generally to a method and a device for reducing the drive delay of a rolling stock to reach a destination.

BACKGROUND ART

Between starting stations and stop stations, rolling stocks have to follow a running profile. The running profile indicates the position, the speed and the acceleration of the rolling stock at successive time instants.

Running profile are typically designed to setup a transit time between starting and stop station, while keeping the speed of the rolling stock below the speed limits imposed by the track and minimizing the energy consumption of the rolling stock during the transit.

The computation of the running profile is typically determined according to assumptions, such as the mass of the rolling stock and of its payload, the slope of the track, the variation law of resistance forces due to air and rail with the speed of the rolling stock, limitations of rolling stock drive to operate at different acceleration notch levels and the availability of electric power at catenary.

In the state of art, automatic train control systems typically apply acceleration levels indicated in the running profile or use speed tracking devices in order to catchup speed with that contained in the running profile.

Using Drive Advice Systems (DAS), human drivers also use graphical representation of ideal and actual train position to help the driving of the rolling stock according to a running profile.

SUMMARY OF INVENTION

Technical Problem

When using state of art train drive systems in practice, the position and speed of train can differ to that indicated in the running profile.

As a typical situation, running profile sometimes indicates an acceleration level which can't be reached by the train drive, resulting in train getting delayed when reaching the destination. For instance, this could be caused by an excess of payload, the presence of strong wind, of rain on the track, or of voltage drops in the catenary.

The present invention aims at reducing the drive delay of a rolling stock to reach a destination.

Solution to Problem

To that end, the present invention concerns a method for reducing the drive delay of a rolling stock to reach a destination, the rolling stock being driven by a driver to follow a running profile that defines the speeds and positions of the rolling stock at different timings, characterized in that the method comprises the steps of:

- determining a current timing,
- getting a nominal acceleration of the rolling stock, the nominal acceleration being determined by the driver of the rolling stock to follow the running profile at the current timing,

- determining the speed error of the rolling stock with the rolling profile,
- determining the position error of the rolling stock with the rolling profile,
- determining an estimate of the time to reach the destination,
- determining a marginal acceleration from the speed error, the position error and the estimated time to reach the destination,
- accelerating the rolling stock with the sum of nominal and determined marginal accelerations.

The present invention concerns also a device for reducing the drive delay of a rolling stock to reach a destination, the rolling stock being driven by a driver to follow a running profile that defines the speeds and positions of the rolling stock at different timings, characterized in that the device comprises:

- means for determining a current timing,
- means for getting a nominal acceleration of the rolling stock, the nominal acceleration being determined by the driver of the rolling stock to follow the running profile at the current timing,
- means for determining the speed error of the rolling stock with the rolling profile,
- means for determining the position error of the rolling stock with the rolling profile,
- means for determining an estimate of the time to reach the destination,
- means for determining a marginal acceleration from the speed error, the position error and the estimated time to reach the destination,
- means for accelerating the rolling stock with the sum of nominal and determined marginal accelerations.

Thus, when the nominal acceleration determined by the driver is not effective to drive the rolling stock according to the running profile, the effective acceleration is modified with the marginal acceleration. The speed and position errors can be compensated and be cancelled at time of reaching the destination. At time to reach the destination, the rolling stock is operating according to the running profile, even in presence of perturbations such as drop in catenary voltage, change in payload mass, presence of wind or rain.

Furthermore, the assistance to driving brought by the present invention relaxes the driver responsibility to tightly respect the running profile. Driver attention is not distracted from safety issues.

According to a particular feature, the destination is the next stop of the rolling stock.

Thus, the rolling stock arrives on time at the station. Delays are not propagated in the railway network.

According to a particular feature, the destination is the position wherein an automatic stop control system starts to manage the stop of the rolling stock.

Thus, automatic stop control system is effective in stopping the rolling stock on time and at precise location along the deck.

According to a particular feature, the destination is the position where the rolling stock enters in a speed limited area.

Thus, the delay is compensated before the rolling stock enters the speed limited area.

The speed of rolling stock does not excess the speed limit after entering the speed limit area.

According to a particular feature, the marginal acceleration is determined as minus the sum of speed error times two times a parameter divided by the time to reach the destination and of position error times the square of the parameter divided by the square of time to reach the destination.

Thus, the error of position and of speed of the rolling stock is effectively reduced without oscillation, and is fully compensated when reaching the destination. As marginal acceleration is not oscillating, the discomfort to passengers is minimized.

According to a particular feature, the parameter is predetermined and is comprised between 3.5 and 5.

Thus, the parameter being fixed, it does not need be adapted with respect to time to reach the destination.

The parameter being higher than two plus the square root of two, the marginal acceleration also gets to zero when reaching the destination. As a result, additional acceleration power is limited, and discomfort brought to passengers is also reduced.

The parameter being lower than 5, the initial marginal acceleration is limited.

According to a particular feature, the parameter is equal to 3.7.

Thus, the parameter exhibits good properties in terms of marginal acceleration.

According to a particular feature, the sum of nominal and marginal accelerations is limited to a maximum acceleration, which is determined as the difference between a speed limit level and the speed of the rolling stock, divided by a time period.

Thus, it will take at least the time period for the speed to start exceeding the speed limit. As the time period is typically higher than the refresh time of the proposed algorithm, the rolling stock can never exceed speed limit and the risk of derailment is reduced.

According to a particular feature, the sum of nominal and marginal accelerations is limited to a minimum acceleration which is determined as minus the measured of the rolling stock divided by the time period.

Thus, it will take at least the time period for the speed to change its sign. As the time period is typically higher than the refresh time of the proposed algorithm, the rolling stock can never change the sign of its speed, and the risk of collision with following train is reduced.

According to a particular feature, the method further comprises the steps of:

- checking if the marginal acceleration is enabled by the driver of the rolling stock,
- adding the marginal acceleration to the nominal acceleration if the marginal acceleration is enabled by the driver of the rolling stock,
- not adding the marginal acceleration to the acceleration of the rolling stock defined by the driver of the rolling stock in order to follow the running profile if the marginal acceleration is not enabled by the driver of the rolling stock.

Thus, the driver is assisted for the recovery of delay in presence of perturbations. The driver also keeps full control of the rolling stock, as it can also decide to disable assistance at any time, e.g. for emergency cases.

According to still another aspect, the present invention concerns computer programs which can be directly loadable into a programmable device, comprising instructions or portions of code for implementing the steps of the method according to the invention, when said computer programs are executed on a programmable device.

Since the features and advantages relating to the computer programs are the same as those set out above related to the method and device according to the invention, they will not be repeated here.

The characteristics of the invention will emerge more clearly from a reading of the following description of example embodiments, the said description being produced with reference to the accompanying drawings, among which:

BRIEF DESCRIPTION OF DRAWINGS

FIG. 1 represents a rolling stock in a system in which the present invention is implemented;

FIG. 2 discloses an algorithm executed by a rolling stock according to the present invention;

FIG. 3 represents an example of a running profile for the speed versus the position of a rolling stock;

FIG. 4 represents an example nominal and marginal accelerations versus the position of a rolling stock.

DESCRIPTION OF EMBODIMENTS

FIG. 1 represents a rolling stock in a system in which the present invention is implemented.

In FIG. 1, a rolling stock 120 is shown. The rolling stock 120 comprises a device for reducing the drive delays of the rolling stock 110. The device for reducing the drive delays of the rolling stock 110 has, for example, an architecture based on components connected together by a communication bus 101 and a processor 100 controlled by the program as disclosed in FIG. 2.

The communication bus 101 links the processor 100 to a read only memory ROM 102, a random access memory RAM 103, nominal acceleration detection module 106, an acceleration command module 109 and timing, rolling stock position and speed determination means 107.

The nominal acceleration detection module 106 detects acceleration commands of the rolling stock which are set by the driver of the rolling stock in order to follow the running profile at the current timing, The processor 100 determines marginal accelerations from speed errors, position errors and the estimated times to reach the destination. The processor 100 sends acceleration commands to the acceleration command module 109 through the communication bus 101.

The acceleration command module 109 controls at least one traction motor of the rolling stock so that the rolling stock accelerates according to the acceleration commands received from the processor 100.

The memory 103 contains registers intended to receive variables and the instructions of the programs related to the algorithm as disclosed in FIG. 2 and a running profile.

The read only memory 102 contains instructions of the programs related to the algorithm as disclosed in FIG. 2, which are transferred, when the device for reducing the drive delays of the rolling stock 110 is powered on, to the random access memory 103.

Any and all steps of the algorithm described hereafter with regard to FIG. 2 may be implemented in software by execution of a set of instructions or program by a programmable computing machine, such as a PC (Personal Computer), a DSP (Digital Signal Processor) or a microcontroller; or else implemented in hardware by a machine or a dedicated component, such as an FPGA (Field-Programmable Gate Array) or an ASIC (Application-Specific Integrated Circuit).

In other words, the device for reducing the drive delays of the rolling stock 110 includes circuitry, or a device including circuitry, causing the device for reducing the drive delays of the rolling stock 110 to perform the steps of the algorithm described hereafter with regard to FIG. 2.

According to the invention, the device for reducing the drive delay of the rolling stock 110:

- determines a current timing,
- gets a nominal acceleration of the rolling stock, the nominal acceleration being determined by the driver of the rolling stock to follow the running profile at the current timing,
- determines the speed error of the rolling stock with the rolling profile,
- determines the position error of the rolling stock with the rolling profile,
- determines an estimate of the time to reach the destination,
- determines a marginal acceleration from the speed error, the position error and the estimated time to reach the destination,
- accelerates the rolling stock with the sum of nominal and determined marginal accelerations.

FIG. 2 discloses an algorithm executed by a rolling stock according to the present invention.

More precisely, the present algorithm is executed by the processor 100 of the device for reducing the drive delays of the rolling stock 110.

At step S200, the processor 100 starts the present algorithm.

At next step S201, the processor 100 obtains the destination position of the rolling stock.

The destination position is the next stop position of the rolling stock or may be a predetermined position along the railway line, such as position to enter the range area of a Train Automatic Stop Control (TASC) system, or may be a position to enter a speed limit section of the railway line.

TASC is a system activated by the driver of the rolling stock prior to reach the destination and which controls the exact positioning of the rolling along a deck of a station. The destination position is for example stored in the RAM memory 103.

At next step S202, the processor 100 gets the running profile of the rolling stock. The running profile indicates timing, positions, speeds the rolling stock should follow if the rolling stock is on time according to a given schedule. The running profile may also indicate the acceleration profile required to keep the schedule. The running profile is for example stored in the RAM memory 103.

At next step S203, the processor 100 gets the rolling stock position and speed. The position and the speed are provided by the rolling stock position and speed determination means 107.

At next step S204, the processor 100 determines the position error $\Delta X$ of the rolling stock for the current time t. The processor 100 subtracts the position $X_{target}(t)$ where the rolling should be located at current time t according to the running profile, from the effective position X(t) of the rolling stock obtained at step S203.

$\Delta X = X(t) - X_{target}(t)$.

At next step S205, the processor 100 determines the speed error $\Delta V$. The processor 100 subtracts the derivation over the time of the position $X_{target}(t)$ where the rolling should be located at current time t according to the running profile, from the effective speed V(t) of the rolling stock obtained at step S203.

$\Delta V = V(t) - dX_{target}(t)/dt(t)$.

At next step S206, the processor 100 determines the time to destination $\Delta T$. The processor 100 subtracts the current time t from the time of arrival $t_a$ when the rolling stock should arrive at the destination according to the running profile.

At next step S207, the processor 100 checks if the time to destination $\Delta T$ is equal to null value.

If the time to destination $\Delta T$ is equal to null value, the processor 100 interrupts the present algorithm. In a variant, the processor moves to step S201, where it determines a next destination position. Otherwise, the processor 100 moves to step S208.

At step S208 the processor 100 determines, according to the present invention, a marginal acceleration $\Delta G$ to be applied.

According to the invention, a decay $\lambda = \Omega/\Delta T$ is dynamic and is determined from time to reach the station. $\Omega$ is a control parameter, typically higher than $2+\sqrt{2}$, for example set in a range between 3.5 and 4. For example, $\Omega$ is equal to 3.7.

The marginal acceleration is determined according to the following formula:

$$\Delta G = -\frac{2\Omega}{\Delta T}\Delta V - \left(\frac{\Omega}{\Delta T}\right)^2 \Delta X \quad \text{[Math. 1]}$$

Assuming that at a first given time instant $t_0$, the rolling stock experienced an initial position error $\Delta X_0$ and a speed error $\Delta V_0$, Mathematical analysis shows that, in absence of further perturbation, speed and position errors jointly reduce with time for successive time instants t ($t_0 < t < t_a$) according to following equations:

$$\Delta X(t) = \alpha_1 (t_a - t)^{\beta_1} + \alpha_2 (t_a - t)^{\beta_2} \quad \text{[Math.2]}$$

$$\Delta V(t) = -\alpha_1 \beta_1 (t_a - t)^{\beta_1 - 1} - \alpha_2 \beta_2 (t_a - t)^{\beta_2 - 1} \quad \text{[Math.3]}$$

$$\Delta G(t) = \alpha_1 \beta_1 (\beta_1 - 1)(t_a - t)^{\beta_1 - 2} + \alpha_2 \beta_2 (\beta_2 - 1)(t_a - t)^{\beta_2 - 2} \quad \text{[Math.4]}$$

where

[Math. 5]

$$\beta_1 = \Omega + \frac{1}{2}\left(1 + \sqrt{1 + 4\Omega}\right) \quad \alpha_1 = -\frac{\Delta X_0 \beta_2 + \Delta V_0 (t_a - t_0)}{(t_a - t_0)^{\beta_1} \sqrt{1 + 4\Omega}}$$

[Math. 6]

$$\beta_2 = \Omega + \frac{1}{2}\left(1 - \sqrt{1 + 4\Omega}\right) \quad \alpha_2 = \frac{\Delta X_0 \beta 1_1 + \Delta V_0 t_a}{(t_a - t_0)^{\beta_2} \sqrt{1 + 4\Omega}}$$

It has to be noted here that if the control parameter $\Omega$ is chosen higher than 2, both speed and position errors get to zero at arrival to destination. If the control parameter $\Omega$ is chosen higher than $2+\sqrt{2}$, the maximum speed error is kept small, and marginal acceleration also gets to zero at arrival to destination. If the control parameter $\Omega$ increases, initial marginal acceleration also increases, and energy consumption of railway degrades.

The value of the control parameter $\Omega$ may be set to a single value for example between 3.5 and 5, typically 3.7, for which speed and position error always reaches zero at the time of reaching the destination, irrespective of initial speed and position errors while minimizing the marginal acceleration and thus the electric power consumption.

At next step S209, the processor 100 obtains the nominal acceleration from the nominal acceleration detection module 106 which detects the acceleration set by the driver of the rolling stock 120. For human-driven rolling stocks, the nominal acceleration is manually set by the human driver e.g. by means of a lever.

For automatic train control systems, the nominal acceleration is determined by nominal acceleration detection module 106 from the running profile. As example, the nominal acceleration is the acceleration indicated for the current time t which is stored in RAM 103. As other example, the nominal acceleration also contains a compensation acceleration resulting from an observed variation of catenary voltage.

At next step S210, the processor 100 determines the effective acceleration $G_{effective}$ to be applied. The processor 100 adds the marginal acceleration ΔG to the nominal acceleration $G_{nominal}$.

It has to be noted here that the effective acceleration may be determined taking into account a maximum acceleration, which is determined as the difference between a speed limit level and the speed of the rolling stock, divided by a time period. As example, the time period is one second.

It has to be noted here that the effective acceleration is further limited to a minimum acceleration, which is determined as minus the speed of the rolling stock divided by a time period. It has to be noted here that the driver of the rolling stock may deactivate the application of the marginal acceleration ΔG.

At next step S211, the processor 100 applies the effective acceleration. The processor 100 sends the acceleration command determined at step S210 to the acceleration command module 109.

At next step S212, the processor 100 waits for next time step. Time steps are typically spaced with few hundreds of milliseconds.

After that, the processor returns to step S203.

FIG. 3 represents an example of a running profile for the speed versus the position of a rolling stock.

The horizontal axis represents the time in second and the vertical axis represents the speed in kilometers per hour that the rolling stock should have.

The speed profile 30*a* of FIG. 3 shows the speed that the driver of the rolling stock has to apply in order to follow the running profile.

In example of FIG. 3 the rolling stock departs from a first stop station at time $t_1$ and stops at a second destination stop station at time $t_2$.

The speed profile 30*b* of FIG. 3 shows the speed of rolling stock when the acceleration is limited. The limitation of acceleration can be caused by a surplus weight of the rolling stock, or due to voltage drop in the catenary line which supplies the rolling stock. Due to limited acceleration, the train is late to acquire cruise speed, which results in a delay when reaching the destination stop station at time $t_{2b}$.

The speed profile 30*c* of FIG. 3 shows the speed of rolling stock when the acceleration is limited and when the train is driven according to the invention. As train has both speed and position errors at the end of acceleration phase, speed evolves according to a marginal acceleration decided by processor 100. Both speed and position errors are recovered at destination point at time $t_a$, and rolling stock then reaches the destination stop station with no delay.

FIG. 4 represents an example nominal and marginal accelerations versus the position of a rolling stock.

The horizontal axis represents the time in second and the vertical axis represents the acceleration of the rolling stock in meters per power of two of seconds.

The acceleration profile noted 40*a* of FIG. 4 shows the acceleration that the driver of the rolling stock has to apply in order to follow the running profile.

The acceleration profile noted 40*b* of FIG. 4 shows the acceleration that the driver of the rolling stock effectively applies when the acceleration is limited.

The acceleration profile noted 40*c* of FIG. 4 shows the acceleration that the driver of the rolling stock effectively applies when the acceleration is limited and when the train is driven according to the invention. Acceleration profile 40*c* differs from acceleration profile 40*b* by the marginal acceleration determined according to the present invention.

Naturally, many modifications can be made to the embodiments of the invention described above without departing from the scope of the present invention.

The invention claimed is:

1. Method for reducing the drive delay of a rolling stock to reach a destination, the rolling stock being driven by a driver to follow a running profile that defines the speeds and positions of the rolling stock at different timings, characterized in that the method comprises:

determining a current time, getting a nominal acceleration of the rolling stock, the nominal acceleration being determined by the driver of the rolling stock to follow the running profile at the current time, determining the speed error of the rolling stock with the running profile, determining the position error of the rolling stock with the running profile, determining an estimate of the time to reach the destination, determining a marginal acceleration from the speed error, the position error and the estimated time to reach the destination, the marginal acceleration is determined as minus the sum of speed error times two times a parameter divided by the time to reach the destination and of position error times the square of the parameter divided by the square of time to reach the destination, accelerating the rolling stock with the sum of nominal and determined marginal accelerations.

2. Method according to claim 1, characterized in that the destination is the next stop of the rolling stock.

3. Method according to claim 1, characterized in that the destination is the position wherein an automatic stop control system starts to manage the stop of the rolling stock.

4. Method according to claim 1, characterized in that the destination is the position where the rolling stock enters in a speed limited area.

5. Method according to claim 1, characterized in that the parameter is predetermined and is comprised between 3.5 and 5.

6. Method according to claim 5, characterized in that the parameter is equal to 3.7.

7. Method according to claim 1, characterized in that the sum of marginal acceleration and the acceleration of the rolling stock is limited to a maximum acceleration, which is determined as the difference between a speed limit level and the speed of the rolling stock, divided by a time period.

8. Method according to claim 1, characterized in that the sum of marginal acceleration and the acceleration of the rolling stock is limited to a minimum acceleration which is determined as minus the measured of the rolling stock divided by the time period.

9. Method according to claim 1, characterized in that the method further comprises:

checking if the marginal acceleration is enabled by the driver of the rolling stock, adding the marginal acceleration to the nominal acceleration if the marginal acceleration is enabled by the driver of the rolling stock, not adding the marginal acceleration to the acceleration of the rolling stock defined by the driver of the rolling stock in order to follow the running profile if the marginal acceleration is not enabled by the driver of the rolling stock.

10. Device for reducing the drive delay of a rolling stock to reach a destination, the rolling stock being driven by a driver to follow a running profile that defines the speeds and positions of the rolling stock at different timings, characterized in that the device comprises:

processing circuitry to determine a current time, to get a nominal acceleration of the rolling stock, the nominal acceleration being determined by the driver of the rolling stock to follow the running profile at the current time, to determine the speed error of the rolling stock with the running profile, to determine the position error of the rolling stock with the running profile, to determine an estimate of the time to reach the destination, to determine a marginal acceleration from the speed error, the position error and the estimated time to reach the destination, the marginal acceleration is determined as minus the sum of speed error times two times a parameter divided by the time to reach the destination and of position error times the square of the parameter divided by the square of time to reach the destination, to accelerate the rolling stock with the sum of nominal and determined marginal accelerations.

* * * * *